US010794234B1

(12) United States Patent
Kim

(10) Patent No.: US 10,794,234 B1
(45) Date of Patent: Oct. 6, 2020

(54) DEVICE FOR VARYING LOAD OF VALVE SYSTEM

(71) Applicants: Hyundai Motor Company, Seoul (KR); Kia Motors Corporation, Seoul (KR)

(72) Inventor: Jung Ho Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/558,673

(22) Filed: Sep. 3, 2019

(30) Foreign Application Priority Data

Apr. 3, 2019 (KR) ..... 10-2019-0039287

(51) Int. Cl.
*F01L 1/46* (2006.01)
*F01L 1/24* (2006.01)
*F01L 1/047* (2006.01)

(52) U.S. Cl.
CPC ..... *F01L 1/2411* (2013.01); *F01L 1/047* (2013.01); *F01L 1/462* (2013.01)

(58) Field of Classification Search
CPC ..... F01L 1/2411; F01L 1/462
USPC ..... 123/90.65, 90.66, 90.67
See application file for complete search history.

(56) References Cited

U.S. PATENT DOCUMENTS

2010/0139596 A1* 6/2010 Iwata ..... F16F 3/04 123/90.67
2012/0210965 A1* 8/2012 Ito ..... F01L 1/462 123/90.44
2017/0342869 A1* 11/2017 Tanaka ..... F01L 1/14

FOREIGN PATENT DOCUMENTS

KR 1994-0000728 10/1996

* cited by examiner

*Primary Examiner* — Jorge L Leon, Jr.
(74) *Attorney, Agent, or Firm* — Mintz Levin Cohn Ferris Glovsky and Popeo, P.C.; Peter F. Corless

(57) ABSTRACT

A device for varying a load of a valve system can vary a load acting on a valve spring in accordance with driving conditions of a vehicle. In the device, in a low load mode, only a first valve spring is compressed, and a second valve spring is not compressed. Accordingly, the load acting on the valve spring is reduced, and as such, an enhancement in fuel economy is achieved. In a high load mode, both the first valve spring and the second valve spring are compressed. Accordingly, the load acting on the valve spring is increased, and as such, it is possible to prevent a danger of breakage occurring due to striking components of a valve train system.

8 Claims, 4 Drawing Sheets

DEVICE FOR VARYING LOAD OF VALVE SYSTEM

CROSS-REFERENCE TO RELATED APPLICATION

This application claims under 35 U.S.C. § 119(a) the benefit of Korean Patent Application No. 10-2019-0039287, filed on Apr. 3, 2019 in the Korean Intellectual Property Office, the entire contents of which are incorporated herein by reference.

BACKGROUND

1. Technical Field

The present disclosure relates to a device for varying a load acting on a valve spring in accordance with driving conditions of a vehicle, in order to enhance fuel economy and durability of components in a valve train system.

2. Description of the Related Art

As a cam shaft rotates, a valve is pressed by a profile of a cam mounted to the cam shaft, and thus the valve is opened. The opened valve is closed by a recovery force of a valve spring.

When a smaller force is needed to rotate the cam shaft, there is an advantage in terms of fuel economy. In this regard, it may be advantageous to use a valve spring having low stiffness.

In this case, however, there may be a problem in that an abnormal phenomenon such as jump or bounce of the valve occurs when an engine associated with the valve rotates at a high speed of greater than or equal to an allowable rotation speed.

Valve jump is a phenomenon that, when the cam presses the valve in a state in which the cam shaft rotates at high speed, a pressing effect of the spring may not be exhibited due to high inertia of the valve, and as such, the valve is lifted after being separated from the nose of the cam. When such valve jump occurs, components of the valve system may strike each other. In an extreme case of valve jump, there may be a problem in that the components become broken or damaged.

Meanwhile, valve bounce is a phenomenon that, when the valve is pressed by the spring to be closed, the valve is bounced to an original position without being maintained such that a valve face thereof contacts a valve seat. Such valve bounce also may cause a problem of damage to the valve system.

In order to solve the above-mentioned problems, a scheme, in which the valve spring is made of a spring material having high stiffness, to enhance stiffness of the valve spring, may be proposed. In this case, however, enhancement effects expected by such a scheme are not remarkable. In particular, when the engine rotates at low speed, the load of the valve spring may become excessively high, and as such, there may be a disadvantage in terms of fuel economy.

The above matters disclosed in this section are merely for enhancement of understanding of the general background of the disclosure and should not be taken as an acknowledgement or any form of suggestion that the matters form the related art already known to a person skilled in the art.

SUMMARY

The present disclosure provides a device for varying a load acting on a valve spring in accordance with driving conditions of a vehicle, in order to enhance fuel economy and durability of components in a valve train system.

In accordance with an aspect of the present disclosure, the above and other objects can be accomplished by the provision of a device for varying a load of a valve system including a first spring retainer configured to move together with a valve in accordance with rotation of a cam, a first valve spring having a first end supported by a cylinder head and a second end supported by the first spring retainer, a second valve spring disposed to surround a portion of the first valve spring, the second valve having a first end supported by the cylinder head, a second spring retainer supported by a second end of the second valve spring, and a piston movable in a longitudinal direction of the valve with respect to the second spring retainer such that the piston is supported by the first spring retainer or spaced apart from the first spring retainer, the piston moving together with the second spring retainer in a state of being supported by the first spring retainer, thereby compressing both the first valve spring and the second valve spring. A valve guide may be fixedly mounted to the cylinder head such that the valve extends through the valve guide. The first valve spring may be supported between the first spring retainer and the valve guide. The second valve spring may be supported between the second spring retainer and the valve guide. The piston may be disposed between the first spring retainer and the second spring retainer.

A retainer spring hole may be formed at a side portion of the second spring retainer such that the first valve spring extends through the retainer spring hole. A retainer flange may be formed at a portion of the second spring retainer around the retainer spring hole such that the retainer flange is supported by the second end of the second valve spring.

A piston spring hole may be formed at a side portion of the piston such that the first valve spring extends through the piston spring hole. A piston flange may be formed at a portion of the piston around the piston spring hole such that the piston flange is selectively supported by the first spring retainer.

The second spring retainer may be fitted in an end of the piston. Oil may be supplied to an interior of the second spring retainer. The oil supplied to the interior of the second spring retainer may be supplied to an interior of the piston, thereby causing the piston to be supported by the first spring retainer while moving in the longitudinal direction of the valve.

The piston and the second spring retainer may be disposed to be aligned with each other in the longitudinal direction of the valve. An oil chamber may be formed at the end of the piston. One end of the second spring retainer may be fitted in the oil chamber. An oil passage may be formed through the second spring retainer, to extend between one end of the second spring retainer and an opposite end of the second spring retainer. Oil introduced into the oil passage through one end of the oil passage may be supplied to the oil chamber after being discharged from an opposite end of the oil passage.

The device may further include a solenoid valve connected to the second spring retainer, the solenoid valve operating to supply oil to the interior of the second spring retainer, an opening/closing valve disposed in the oil passage of the second spring retainer such that the opening/closing valve opens or closes the oil passage, thereby maintaining or releasing an internal oil pressure of the piston, and a controller configured to receive driving conditions of a vehicle, thereby determining a spring load mode, and to control operation of the solenoid valve and operation of the opening/closing valve in accordance with the determined spring load mode, for selective introduction of oil into the piston.

In a high load mode requiring a relatively high spring load, the controller may perform control to turn on the solenoid valve and to close the opening/closing valve, thereby supplying oil to the interior of the piston such that a desired oil pressure in the piston is maintained. In a low load mode requiring a relatively small spring load, the controller may perform control to turn off the solenoid valve and to open the opening/closing valve, thereby discharging oil from the piston.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE PREFERRED EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles. The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Reference will now be made in detail to the preferred embodiments of the present disclosure, examples of which are illustrated in the accompanying drawings. Wherever possible, the same reference numbers will be used throughout the drawings to refer to the same or like parts.

Figure 1:
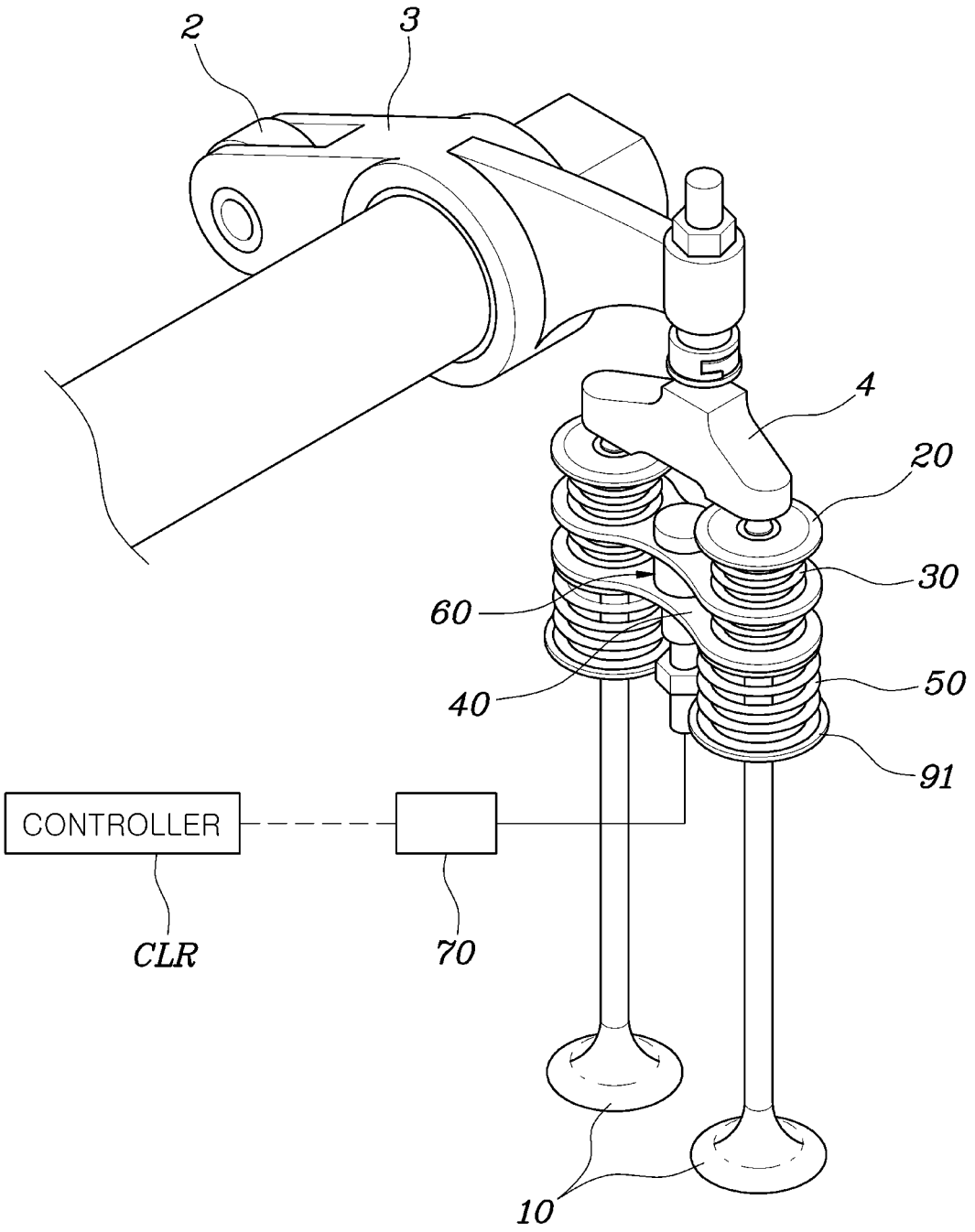
FIG. 1 is a perspective view illustrating the overall configuration of a load varying device according to the present disclosure.
Figure 2:
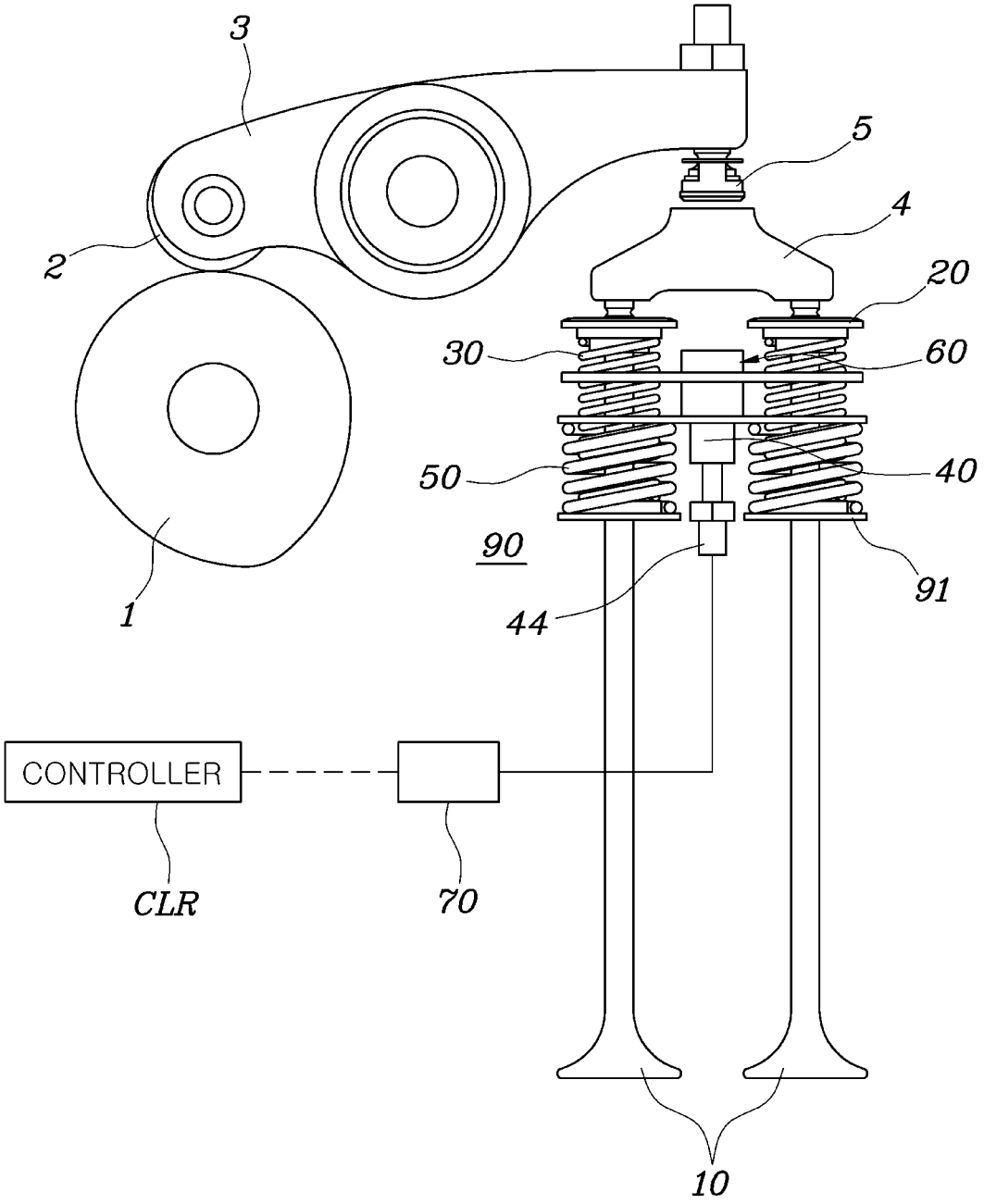
FIG. 2 is a front view of the load varying device illustrated in FIG. 1.

Hereinafter, a configuration of a valve system, to which the present disclosure is applied, will be described with reference to FIGS. 1 and 2. Referring to FIGS. 1 and 2, a roller pin 2 is rotatably mounted to one end of a rocker arm 3. A cam 1 is in contact with the roller pin 2 at an outer peripheral surface thereof. Accordingly, the rocker arm 3 rotates in a seesaw manner in accordance with rotation of the cam 1. Thus, valve timing, lift, and duration are determined in accordance with a cam profile of the cam 1.

A screw 5 is fixedly fitted in the other end of the rocker arm 3. A valve bridge 4 is supported by a lower end of the screw 5. An intake valve or an exhaust valve (hereinafter collectively referred to as a "valve") is disposed at a lower end of the valve bridge 4 such that the valve, which is designated by reference numeral "10", is opened when pressed by the valve bridge 4.

A valve spring is provided at each valve 10 such that the valve spring surrounds the valve 10. The valve 10 is returned to an original position thereof by an elastic recovery force of the valve spring, and as such, is closed.

Meanwhile, the present disclosure provides a device for varying a load of the above-described valve system. The device according to the present disclosure includes two valve springs, two spring retainers, and a piston 60.

Referring to FIGS. 1 and 2, a first spring retainer 20 is coupled to an upper end of each valve 10. The first spring retainer 20 is moved together with the valve 10 in accordance with rotation of the cam 1.

A first valve spring 30 is supported by a cylinder head 90 at a lower end (first end) thereof while being supported by the first spring retainer 20 at an upper end (second end) thereof.

A second valve spring 50 is also provided such that the second valve spring 50 surrounds a lower portion of the first valve spring 30. The second valve spring 50 is supported by the cylinder head 90 at a lower end (first end) thereof.

The second valve spring 50 is supported by a lower surface of a second spring retainer 40 at an upper end (second end) thereof.

In particular, a piston is provided such that the piston 60 is movable with respect to the second spring retainer 40 in a longitudinal direction of the valve 10. That is, the piston 60 is movable between a state in which the piston 60 is supported by the first spring retainer 20 and a state in which the piston 60 is spaced apart from the first spring retainer 20. In a state of being supported by the first spring retainer 20, the piston 60 functions to compress both the first valve spring 30 and the second valve spring 50 while moving together with the second spring retainer 40.

That is, the piston 60 is configured to be spaced apart from the first spring retainer 20 during rotation of an engine at low or middle speed, in a driving range of the engine at a low exhaust back pressure, or the like, because there is no problem even though the load acting on the valve springs is small. In this state, accordingly, the force to move the first spring retainer 20 during movement of the valve 10 is not transmitted to the piston 60, and as such, is also not transmitted to the second spring retainer 40.

As a result, in accordance with movement of the first spring retainer 20, only the first valve spring 30 is compressed, whereas the second valve spring 50 is not compressed. Accordingly, the load acting on the valve springs is relatively small, and as such, an enhancement in fuel economy may be achieved through a reduction in friction.

On the other hand, the piston 60 is configured to be supported by the first spring retainer 20 during rotation of an engine at high speed, in a driving range of the engine at a high exhaust back pressure, or the like, because the load acting on the valve springs should be high. In this state, accordingly, the force to move the first spring retainer 20 during movement of the valve 10 is transmitted to the piston 60, and as such, is also transmitted to the second spring retainer 40.

As a result, in accordance with movement of the first spring retainer 20, the first valve spring 30 is compressed, and at the same time, the piston 60 and the second spring retainer 40 are moved, thereby compressing the second valve spring 50. Accordingly, the load acting on the valve springs is relatively high, and as such, a danger of breakage occurring when components of the valve train system strike each other may be prevented.

Hereinafter, coupling configurations of the first valve spring 30, the second valve spring 50 and the piston 60 will be described herein. The cylinder head 90 is formed with a hole, through which each valve 10 extends. A valve guide 91 is fixedly fitted in the hole. The valve 10 extends through the valve guide 91.

The upper and lower ends of the first valve spring 30 are supported by a lower surface edge of the first spring retainer 20 and an upper surface edge of the valve guide 91, respectively.

In addition, the upper and lower ends of the second valve spring 50 are supported by a lower surface edge of the second spring retainer 40 and another upper surface edge of the valve guide 91, respectively.

The piston 60 is disposed between the first spring retainer 20 and the second spring retainer 40.

A retainer spring hole 41 is formed at a side portion of the second spring retainer 40 corresponding to each valve 10. The first valve spring 30 associated with the valve 10 extends through the retainer spring hole 41.

A retainer flange 42 is formed at a lower surface portion of the second spring retainer 40 around the retainer spring hole 41. The retainer flange 42 is supported by the upper end of the second valve spring 50.

In addition, a piston spring hole 61 is formed at a side portion of the piston 60 corresponding to each valve 10. The first valve spring 30 associated with the valve 10 extends through the piston spring hole 61.

A piston flange 62 is formed at an upper surface portion of the piston 60 around the piston spring hole 61. The piston flange 62 may be configured to be selectively supported by another lower surface edge of the first spring retainer 20.

The valves 10 may be disposed at opposite sides of the cylinder head 90, respectively, and as such, the second spring retainer 40 and the piston 60 may be disposed between the opposite valves 10. In this case, two retainer flanges 42 may be formed at opposite side portions of the second spring retainer 40, respectively, and two piston flanges 62 may be formed at opposite side portions of the piston 60, respectively. In this case, two first valve springs 30 may extend through the opposite side portions of the second spring retainer 40 and the piston 60, respectively.

In accordance with the above-described configuration, during movement of each valve 10, the first spring retainer 20 compresses the first valve spring 30. In a state in which the piston 60 is supported by the first spring retainer 20, the first spring retainer 20 pushes the piston flange 62 downwards, thereby causing the piston 60 and the second spring retainer 40 to move downwards. At the same time, the retainer flange 42 pushes the second valve spring 50 downwards, thereby causing the first valve spring 30 and the second valve spring 50 to be simultaneously compressed.

Of course, in a state in which the piston 60 is spaced apart from the first spring retainer 20, the second valve spring 50 is not compressed during movement of the valve 10, even though the first valve spring 30 is compressed by the first spring retainer 20. Meanwhile, in accordance with the present disclosure, the piston 60 may be configured to be movable in accordance with an oil pressure applied thereto.

Figure 3:
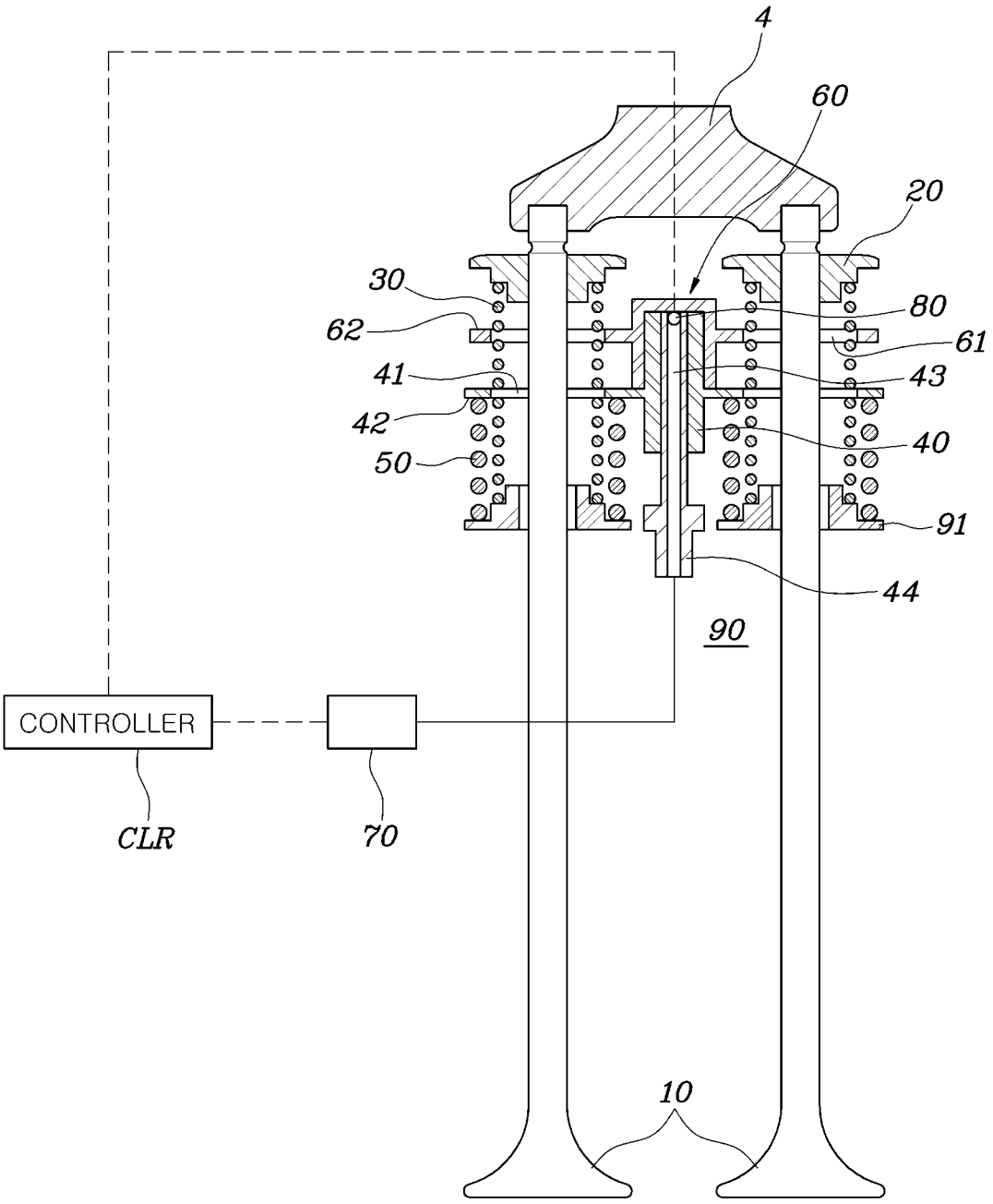
FIG. 3 is a sectional view illustrating a state in which only a first valve spring operates in a low load mode according to the present disclosure.
Figure 4:
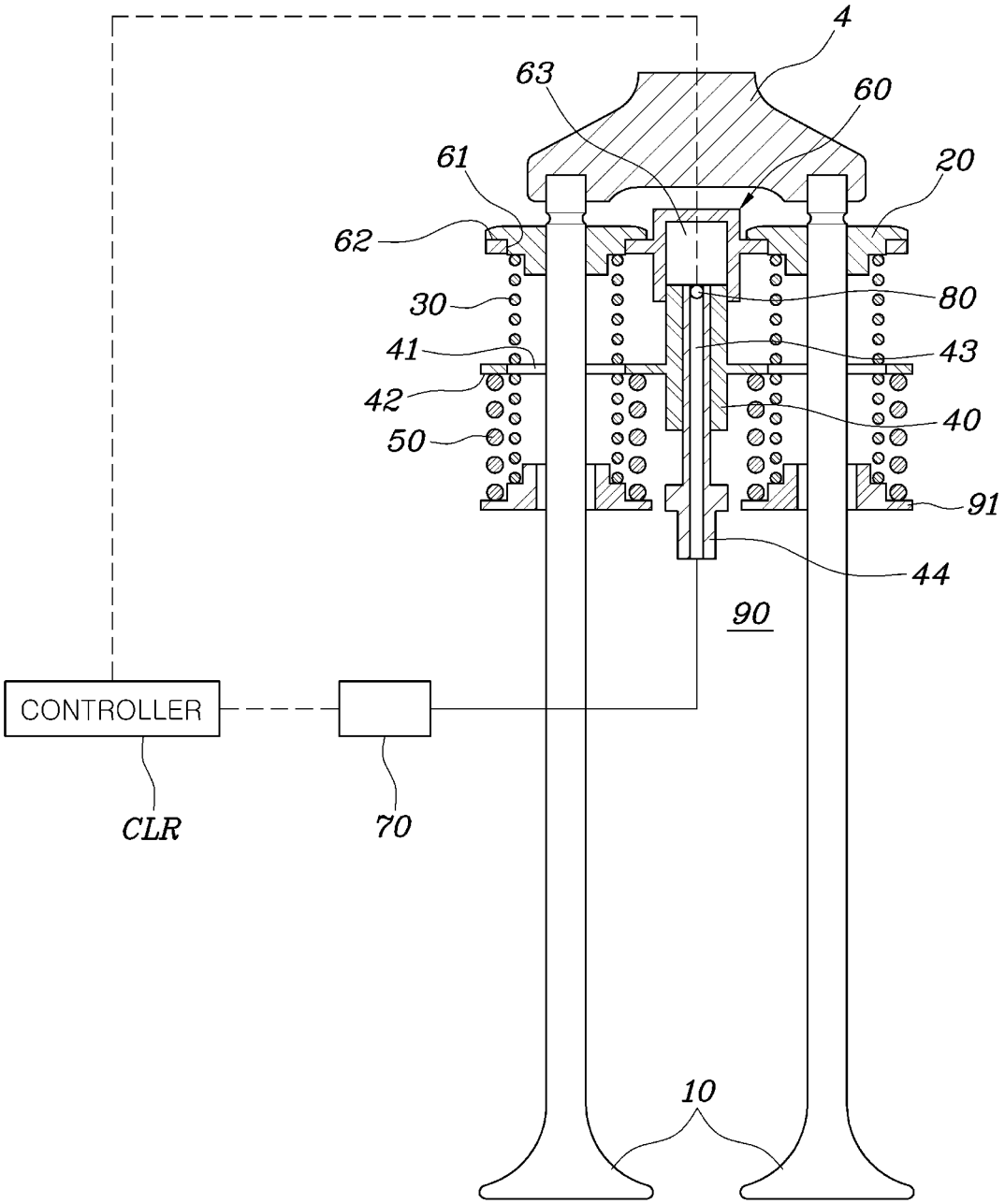
FIG. 4 is a sectional view illustrating a state in which a second valve spring operates together with the first valve spring in a high load mode according to the present disclosure.

For this configuration, referring to FIGS. 3 and 4, the second spring retainer 40 is fitted in an end of the piston 60, and oil is supplied to the interior of the second spring retainer 40.

The oil supplied to the interior of the second spring retainer 40 is then supplied to the piston 60, and as such, the piston 60 is moved in a longitudinal direction of the valve 10 such that the piston 60 is finally supported by the first spring retainer 20.

In particular, the piston 60 and the second spring retainer 40 are disposed to be aligned with each other in the longitudinal direction of the valve 20. A cylindrical oil chamber 63 is formed at the end of the piston 60.

One end of the second spring retainer 40 is fitted in the oil chamber 63. An oil passage 43 is formed within the second spring retainer 40, to extend between one end of the second spring retainer 40 and the other end (opposite end) of the second spring retainer 40.

Thus, oil introduced into the oil passage 43 through one end of the oil passage 43 is discharged from the oil passage 43 through the other end (opposite end) of the oil passage 43, and as such, is supplied to the oil chamber 63.

In this case, an oil supply tube 44 may be fitted in the oil passage 43 such that the oil supply tube 44 extends outwards from the oil passage 43, and as such, oil may be supplied to the oil passage 43 via the oil supply tube 44.

Meanwhile, in accordance with the present disclosure, it may be possible to positively control whether or not supply of oil to the oil chamber 63 should be carried out.

For this configuration, a solenoid valve 70 is connected to the second spring retainer 40. The solenoid valve 70 operates to supply oil to the interior of the second spring retainer 40

In addition, an opening/closing valve 80 is provided at the oil passage 43 of the second spring retainer 40, to open or close the oil passage 43. That is, the opening/closing valve 80 functions to maintain or release an internal oil pressure of the piston 60. In this case, the opening/closing valve 80 may be operated by operation of an actuator.

In particular, a controller CLR may receive an input representing driving conditions of the vehicle, and may determine a spring load mode based on the received input. In accordance with the determined spring load mode, the controller CLR may control operation of the solenoid valve 70 and operation of the opening/closing valve 80, for selective introduction of oil into the piston 60.

Here, the driving conditions input to the controller CLR are conditions for determining a required load acting on the valve spring. The driving conditions may include engine RPM, an exhaust brake operating signal, etc.

For reference, in accordance with an exemplary embodiment of the present disclosure, the controller may be embodied through a non-volatile memory (not shown) configured to store data as to an algorithm configured to control operation of various constituent elements of the vehicle or software commands to reproduce the algorithm, and a processor (not shown) configured to execute operations to be described hereinafter, using the data stored in the memory. Here, the memory and the processor may be embodied as individual chips, respectively. Alternatively, the memory and the processor may be embodied as a single integrated chip. The processor may take a structure including one or more processors.

That is, in a low or middle rotation speed condition in which an engine RPM is low or in a driving condition in which an exhaust back pressure is low, such a condition is determined to be a low load mode allowing a small spring load. On the other hand, in a high rotation speed condition in which an engine RPM is high or in a driving condition in which an exhaust back pressure is high in accordance with operation of an exhaust brake, such a condition is determined to be a high load mode requiring a high spring load.

In particular, in the high load mode requiring a relatively high spring load, the controller CLR turns on the solenoid valve 70, and closes the opening/closing valve 80. That is, the controller CLR performs control for maintaining a desired oil pressure in the piston 60 while supplying oil to the interior of the piston 60.

On the other hand, in the low load mode requiring a relatively small spring load, the controller CLR turns off the solenoid valve 70, and opens the opening/closing valve 80. That is, the controller CLR performs control for discharging oil from the piston 60.

Hereinafter, operation of the valve spring in the low load mode will be described with reference to FIG. 3. Upon determining that the current driving condition corresponds to the low load mode allowing the load acting on the valve spring to be small, the solenoid valve 70 is turned off, and the opening/closing valve 80 is operated to be opened.

As a result, no oil is supplied to the oil passage 43 and the oil chamber 63. Accordingly, the piston 60 moves downwards toward the second spring retainer 40, and as such, the piston flange 62 of the piston 60 is spaced apart from the first spring retainer 20.

When the valve 10 operates to be opened in accordance with downward movement thereof in the above-described state, the first spring retainer 20 pushes the first valve spring 30, thereby compressing the first valve spring 30. However, the first spring retainer 20 does not press the piston 60. As a result, both the piston 60 and the second spring retainer 40 do not move, and as such, the second valve spring 50 is not compressed.

Thus, in accordance with movement of the first spring retainer 20, only the first valve spring 30 is compressed, and the second valve spring 50 is not compressed. Accordingly, the load acting on the valve spring is relatively small, and as such, an enhancement in fuel economy may be achieved through a reduction in friction.

Next, operation of the valve spring in the high load mode will be described with reference to FIG. 4. Upon determining that the current driving condition corresponds to the high load mode requiring the load acting on the valve spring to be high, the solenoid valve 70 is turned on.

In this case, oil is pumped to be supplied to the oil passage 43, and as such, fills the oil chamber 63. As a result, the piston 60 moves upwards toward the first spring retainer 20, and as such, the piston flange 62 of the piston 60 is supported by the first spring retainer 20. In this state, the opening valve 80 is closed, and as such, a desired oil pressure may be maintained in the oil chamber 63.

When the valve 10 operates to be opened in accordance with downward movement thereof in the above-described state, the first spring retainer 20 pushes the first valve spring 30, thereby causing the first valve spring 30 to be compressed. At the same time, the first spring retainer 20 presses the piston 60. As a result, both the piston 60 and the second spring retainer 40 move downwards, and as such, the second valve spring 50 is also compressed.

Thus, in accordance with movement of the first spring retainer 20, the first valve spring 30 is compressed, and, at the same time, the second valve spring 50 is compressed. Accordingly, the load acting on the valve spring is relatively high, and as such, it may be possible to prevent a danger of breakage occurring due to striking of components of the valve train system.

As apparent from the above description, in a low load mode, in accordance with movement of the first spring retainer, only the first valve spring is compressed, and the second valve spring is not compressed. Accordingly, the load acting on the valve spring is relatively small, and as such, there may be an effect in that an enhancement in fuel economy may be achieved through a reduction in friction. In addition, in a high load mode, in accordance with movement of the first spring retainer, the first valve spring is compressed, and, at the same time, the second valve spring is compressed. Accordingly, the load acting on the valve spring is relatively high, and as such, there may be an effect in that it may be possible to prevent a danger of breakage occurring due to striking of components of the valve train system.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A device for varying a load of a valve system, the device comprising:

a first spring retainer configured to move together with a valve in accordance with rotation of a cam;

a first valve spring having a first end supported by a cylinder head and a second end supported by the first spring retainer;

a second valve spring disposed to surround a portion of the first valve spring, the second valve having a first end supported by the cylinder head;

a second spring retainer supported by a second end of the second valve spring; and a piston configured to move in a longitudinal direction of the valve with respect to the second spring retainer so as to selectively switch between (a) a first position in which the piston is engaged with and supported by the first spring retainer, and (b) a second position in which the piston is spaced apart from the first spring retainer, wherein the piston moves together with the second spring retainer when in the first position so as to enable compression of the first valve spring and the second valve spring, and wherein compression of only the first valve spring is enabled when the piston is in the second position.

2. The device according to claim 1, wherein:

a valve guide is fixedly mounted to the cylinder head such that the valve extends through the valve guide;

the first valve spring is supported between the first spring retainer and the valve guide;

the second valve spring is supported between the second spring retainer and the valve guide; and the piston is disposed between the first spring retainer and the second spring retainer.

3. The device according to claim 2, wherein:

a retainer spring hole is formed at a side portion of the second spring retainer such that the first valve spring extends through the retainer spring hole; and a retainer flange is formed at a portion of the second spring retainer around the retainer spring hole such that the retainer flange is supported by the second end of the second valve spring.

4. The device according to claim 2, wherein:

a piston spring hole is formed at a side portion of the piston such that the first valve spring extends through the piston spring hole; and a piston flange is formed at a portion of the piston around the piston spring hole such that the piston flange is selectively supported by the first spring retainer.

5. The device according to claim 1, wherein:

the second spring retainer is fitted in an end of the piston;

oil is supplied to an interior of the second spring retainer; and the oil supplied to the interior of the second spring retainer is supplied to an interior of the piston, thereby causing the piston to be supported by the first spring retainer while moving in the longitudinal direction of the valve.

6. The device according to claim 5, wherein:

the piston and the second spring retainer are disposed to be aligned with each other in the longitudinal direction of the valve;

an oil chamber is formed at the end of the piston;

one end of the second spring retainer is fitted in the oil chamber;

an oil passage is formed through the second spring retainer so as to extend between the one end of the second spring retainer and an opposite end of the second spring retainer; and oil introduced into the oil passage through one end of the oil passage is supplied to the oil chamber after being discharged from an opposite end of the oil passage.

7. The device according to claim 5, further comprising:

a solenoid valve connected to the second spring retainer, the solenoid valve configured to supply oil to the interior of the second spring retainer;

an opening/closing valve disposed in an oil passage of the second spring retainer such that the opening/closing valve opens or closes the oil passage, thereby maintaining or releasing an internal oil pressure of the piston; and a controller configured to receive driving conditions of a vehicle, thereby determining a spring load mode, and to control operation of the solenoid valve and operation of the opening/closing valve in accordance with the determined spring load mode.

8. The device according to claim 7, wherein:

when the determined spring load mode is a high load mode, the controller performs control to turn on the solenoid valve and to close the opening/closing valve, thereby supplying oil to the interior of the piston such that a target oil pressure in the piston is maintained; and when the determined spring load mode is a low load mode, the controller performs control to turn off the solenoid valve and to open the opening/closing valve, thereby discharging oil from the piston.

* * * * *